US005179313A

United States Patent [19]

Eves et al.

[11] Patent Number: 5,179,313

[45] Date of Patent: Jan. 12, 1993

[54] FORMING AN EROSION RESISTANT TIP ON AN ELECTRODE

[75] Inventors: Terence J. Eves, Hockley; Jeffrey W. Margetts, Laindon Basildon; Graham E. Palmer, Enfield, all of Great Britain

[73] Assignee: Ford Motor Company, Dearborn, Mich.

[21] Appl. No.: 834,542

[22] PCT Filed: Aug. 10, 1990

[86] PCT No.: PCT/GB90/01261

§ 371 Date: Mar. 5, 1992

§ 102(e) Date: Mar. 5, 1992

[87] PCT Pub. No.: WO91/02393

PCT Pub. Date: Feb. 21, 1991

[30] Foreign Application Priority Data

Aug. 11, 1989 [GB] United Kingdom ..... 8918361

[51] Int. Cl.[5] ..... H01T 21/02

[52] U.S. Cl. ..... 313/141; 445/7; 228/160

[58] Field of Search ..... 445/7; 228/160; 313/141, 142

[56] References Cited

U.S. PATENT DOCUMENTS

| | | | |
|---|---|---|---|
| 3,868,530 | 2/1975 | Eaton et al. | 445/7 X |
| 4,073,425 | 2/1978 | Bollian | 228/160 X |
| 4,699,600 | 10/1987 | Kondo | 445/7 |
| 4,700,103 | 10/1987 | Yamaguchi et al. | 313/141 |
| 4,803,395 | 2/1989 | Matesco | 313/141 |
| 4,810,220 | 3/1989 | Moore | 445/7 |
| 4,826,462 | 5/1989 | Lenk | 445/7 |

FOREIGN PATENT DOCUMENTS 2552947 4/1985 France .

*Primary Examiner*—Kenneth J. Ramsey

*Attorney, Agent, or Firm*—Joseph W. Malleck; Roger L. May

[57] ABSTRACT

To apply an erosion resistant tip, for example a platinum tip to an electrode 10, a wire 12 is fed onto the electrode and the tip welded to the electrode; the end of the wire is severed to leave a pellet 20 attached to the electrode; the pellet is coined and a subsequent welding operation takes place which results in the pellet penetrating into the end face of the electrode.

9 Claims, 2 Drawing Sheets

FORMING AN EROSION RESISTANT TIP ON AN ELECTRODE

BACKGROUND OF THE INVENTION

1. Technical Field

This invention relates to the formation of an erosion resistant tip on an electrode, for example on one or both electrodes of a spark plug for use in an internal combustion engine; to an electrode having a tip formed by this process and to a spark plug in which either one or both electrodes are provided with tips formed in accordance with this process.

2. Description of the Prior Art

In order to achieve greater spark plug life and/or to allow the area of the electrode to be reduced to produce more efficient ignition, it is desirable to place and the electrode tips an erosion resistant material One suitable material is platinum, but any material which is more resistant to chemical erosion than Inconel may be used. Inconel is the conventional material used for spark plug electrodes and the name Inconel is a Registered Trade mark.

It is known from U.S. Pat. No. 4 810 220 to apply the platinum or other erosion resistant material using a sphere which is welded onto the respective base electrodes. However these spheres are necessarily of small size and therefore difficult to handle. Similar methods using platinum discs rather than spheres are also known. It is also known from U.S. Pat. No. 4 705 486 to weld a strip of platinum ribbon to the electrode.

In all these methods, it has proved difficult to ensure the necessary penetration of the platinum metal into the substrate to ensure that the platinum tip remains in place under service conditions.

SUMMARY OF THE INVENTION

According to the present invention, there is provided a process for applying an erosion resistant tip to an electrode, wherein the erosion resistant material is supplied in the form of a continuous wire, the end of the wire is welded to the electrode, the wire is severed at a predetermined distance from the weld to leave a pellet welded to the electrode, a coining operation is carried out to flatten the pellet onto the electrode and finally a second welding operation is carried out during which pressure is applied to the pellet to force the pellet into the material of the electrode.

The erosion resistant material is preferably platinum, and a grain stabilised platinum is particularly suitable.

The welding operations are preferably carried out by electrical resistance welding. The first welding operation is preferably carried out under conditions such that the weld formed is just sufficient to retain the wire secured to the electrode whilst the end of the wire is severed to separate the pellet from the remainder of the wire and during a subsequent coining operation.

The leading end of the wire is preferably pointed or tapered so as to form a contact area with the electrode which is smaller than the cross-sectional area of the wire. This can normally be accomplished by leaving the end of the wire "as sheared".

It is advantageous for the first welding operation to produce a minimum welded area, because when the second welding operation takes place the flow path for the welding current will be smaller, thus producing a higher temperature which allows some melting of the electrode so that the pellet can be pressed into the material of the electrode.

Where the electrode is the centre electrode of a spark plug, the electrode is preferably machined in a subsequent stage so that the exposed end of the electrode is entirely covered by the erosion resistant material.

Where the electrode is the side electrode of a spark plug, the tip material preferably lies substantially flush with the electrode material following the second welding operation.

According to a second aspect of the invention, there is provided an electrode to which an erosion resistant tip has been applied by the method set forth above. The electrode may be the centre electrode or the side electrode of a spark plug, and the invention extends to a spark plug which has a so-formed electrode tip on either or both electrodes.

The erosion resistant tip is preferably of platinum.

DETAILED DESCRIPTION OF PREFERRED EMBODIMENTS

Figure 1:
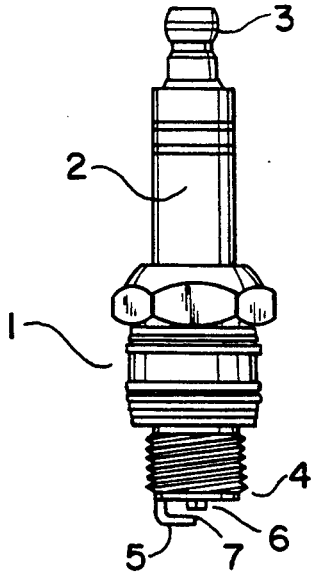
FIG. 1 is a schematic elevational view showing a conventional spark plug for a motor vehicle engine.

The spark plug shown in FIG. 1 has a body 1, an insulator 2, a top contact or cap 3 and a shell 4. The shell has threads by which the plug can be screwed into a tapped bore in a cylinder head, and a side electrode 5 is attached to the shell. A centre electrode 6 is insulated from the side electrode by the insulator 2, and a spark gap 7 is provided between the two electrodes.

Figure 2:
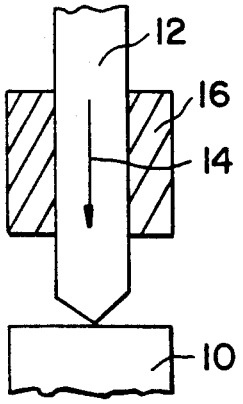
FIGS. 2 to 6 are schematic elevational views of an electrode and the show sequential stages in making such electrode in accordance with the invention.

FIG. 2 shows an electrode 10 of Inconel material and a grain stabilised platinum wire 12 which is fed onto the end of the electrode 10, as indicated by an arrow 14, by a collet 16 which both grips and feeds the wire and also acts as a top electrode. The leading tip of the wire 12 is of a somewhat pointed shape, resulting from a previous cropping operation. For example, the platinum wire may be of the grade sold under the Trade Mark ODS by the Engelhardt company.

Figure 3:
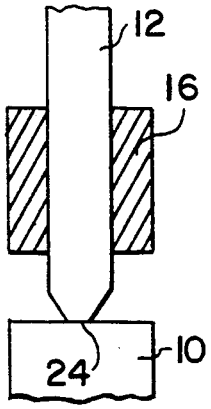

Once the tip of the wire 12 is in contact with the electrode 10, a resistance welding operation takes place to reach the position of FIG. 3, where the pointed end of the wire has spread on and welded to the electrode. At this point all that is necessary is that the wire be "tacked" to the electrode and the strength of the connection between the wire and the electrode need only be sufficient to withstand any forces applied as a result of the two following steps shown in FIGS. 4 and 5.

Figure 4:
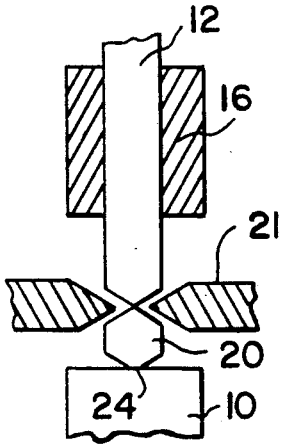

FIG. 4 shows the wire 12 being cropped above the electrode by a cropping shear 21 so as to leave a predetermined amount of material in the form of a pellet 20 attached to the electrode 10. The shear will be constructed so that it leaves either a diametrical ridge or a point on the bottom end of the wire 12, so that the exposed wire end is ready to be "tacked" to the next electrode 10.

Figure 5:
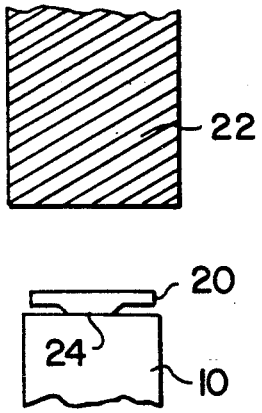

In the next stage shown in FIG. 5, a coining operation is carried out in which the platinum pellet 20 is hit by a tool 22 so that it is flattened against the electrode. It will be seen from FIG. 5 that the platinum remains welded to the electrode at a centre portion 24, but that the outer diameter of the pellet is not welded. In practical terms however the outer parts of the pellet will be in close contact with the electrode, and in this respect the drawing is shown with the annular gap between the electrode and the platinum somewhat exaggerated.

Figure 6:
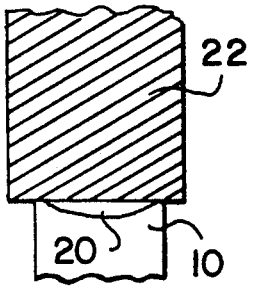
Figure 8:
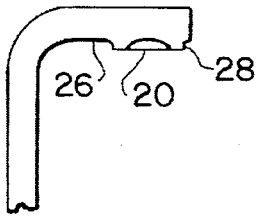
Figure 9:
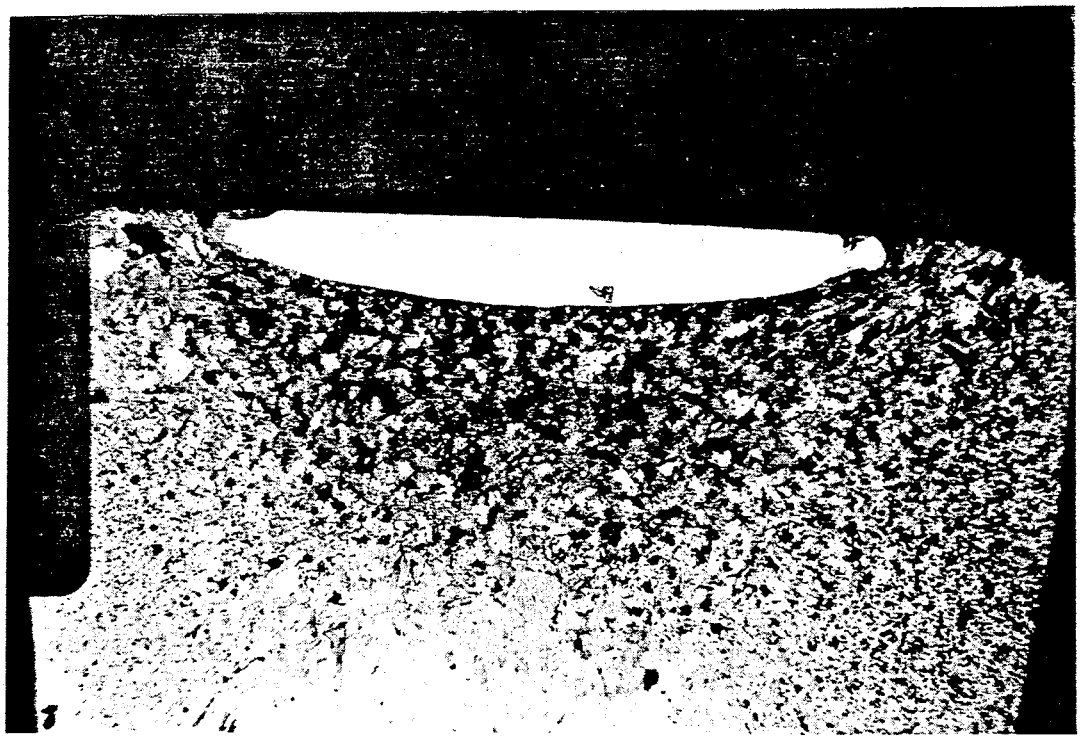
FIG. 9 is a photographic representation of a centre electrode in accordance with the invention, before machining.

In a final stage shown in FIG. 6, a second resistance welding operation takes place accompanied by the use of a substantial downward pressure on the pellet 20 which produces some local melting of the electrode to produce a structure as shown in FIGS. 6 and 8.

Figure 7:
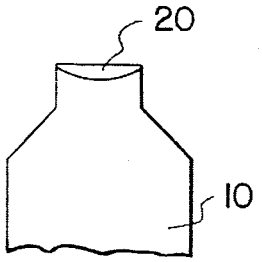
FIGS. 7 and 8 show the final products in the form of, respectively, a centre electrode and a side electrode of a spark plug for an internal combustion engine.

When the electrode is to be used as a centre electrode, a subsequent machining operation takes place in which the shoulders of the Inconel electrode which have not been covered with platinum are removed to leave an electrode which has a tip entirely of platinum, as shown in FIG. 7. where the electrode is to be used as a side electrode as shown in FIG. 8, then it is desirable that the pellet of platinum material be pressed into the electrode material. Pressing in of the pellet whilst the material of the pellet and of the side electrode are both hot causes some displacement cf the Inconel material which then forms a shoulder 28 around the flattened pellet 20. This shoulder helps to protect the weld between the Inconel electrode and the platinum pellet from chemical attack and corrosion while the spark plug is in service.

The side electrode 26 will normally be welded onto the spark plug shell in the straight condition. The platinum pellet 20 will then be welded onto the electrode, and the electrode will then be bent over to its final position, where the platinum pellets on the two electrodes register with one another.

The process described and shown here provides all the known advantages of the use of an erosion resistant tip on a spark plug electrode, but also provides a relatively simple but effective manufacturing process by which the tip can be reliably and permanently attached to the end of the electrode.

The weld energy applied during the welding operations is determined by controlling the volts and amps applied to the welding head, together with the number of cycles. The weld energy is usually expressed in the units kVAT.

In the second welding operation which is where the permanent attachment of the platinum to the electrode takes place the current applied may be 1600 amps for two to three cycles. The pressure applied by the coining tool 22 may be 40 to 50 psi. These figures are for a wire diameter of 0.9 mm which has been cropped to give a platinum pellet weighing from 8 to 12 mg. Wire diameters of between 0.85–1.0 mm can be used. The diameter of the pellet after coining amounts to 1.5 to 1.6 mm.

After the welding current has ceased, a weld force continues to be imposed for a certain length of time, and this weld force can amount to about 60 lbs.

We claim:

1. A process for applying an erosion resistant tip to an electrode comprising:

welding the end of a continuous wire, constituted of an erosion resistant material, to the electrode;

(b) severing the wire at a predetermined distance from the weld to leave a pellet welded to the electrode;

(c) flattening the pellet onto the electrode by coining; and (d) conducting a second welding during which pressure is applied to the pellet to force the pellet into the material of the electrode.

2. A process as claimed in claim 1, wherein the erosion resistant material is platinum.

3. A process as claimed in claim 1, wherein the weldings are carried out by electrical resistance welding.

4. A process as claimed in claim 1, wherein the first welding operation is carried out under conditions such that the weld formed is just sufficient to retain the wire secured to the electrode whilst the end of the wire is severed to separate the pellet from the remainder of the wire and during a subsequent coining operation.

5. A process as claimed in claim 1, wherein the leading end of the wire is pointed or tapered so as to form a contact area with the electrode which is smaller than the cross-sectional area of the wire.

6. A process as claimed in claim 1, wherein the electrode is the centre electrode of a spark plug, and the electrode is machined in a subsequent stage so that the exposed end of the electrode is entirely covered by the erosion resistant material.

7. A process as claimed in claim 1, wherein the electrode is the side electrode of a spark plug, the erosion resistant material lies flush with the electrode material following the second welding operation.

8. An electrode to which an erosion resistant tip has been applied by the process as claimed in claim 1.

9. A spark plug wherein either or both of the centre electrode or the side electrode have an erosion resistant tip which has been applied by the process as claimed in claim 1.

* * * * *